United States Patent [19]

Parra

[11] Patent Number: 4,619,556

[45] Date of Patent: Oct. 28, 1986

[54] METHOD AND APPARATUS FOR SEVERING A TUBULAR MEMBER

[76] Inventor: Ernest P. Parra, 1909 Laredo Dr., Houma, La. 70360

[21] Appl. No.: 550,821

[22] Filed: Nov. 14, 1983

[51] Int. Cl.[4] ..... E02D 5/32; E02D 7/24; E02D 9/04

[52] U.S. Cl. ..... 405/195; 405/226; 405/227; 405/232; 405/248

[58] Field of Search ..... 405/156, 173, 195, 216, 405/224, 226, 227, 232, 234, 235, 248; 166/55, 55.1, 297, 299; 175/4.5, 4.6; 83/53

[56] References Cited

U.S. PATENT DOCUMENTS

| | | | |
|---|---|---|---|
| 2,699,721 | 2/1947 | Klotz, Jr. | 175/4.6 |
| 3,224,204 | 12/1965 | Siebenhauser | 166/55 X |
| 3,369,759 | 8/1967 | Cooper | 405/227 |
| 3,720,068 | 3/1973 | Rosa | 405/195 |
| 3,815,374 | 6/1974 | Hogan | 405/248 |
| 3,890,794 | 6/1975 | Broadfoot | 405/216 |
| 4,290,486 | 9/1981 | Regalbuto | 166/297 |

FOREIGN PATENT DOCUMENTS

| | | | |
|---|---|---|---|
| 2543321 | 4/1977 | Fed. Rep. of Germany | 405/226 |

*Primary Examiner*—Cornelius J. Husar
*Assistant Examiner*—Nancy J. Stodola
*Attorney, Agent, or Firm*—Vaden, Eickenroht, Thompson & Boulware

[57] ABSTRACT

There are disclosed a method and apparatus for severing a tubular member at a desired level beneath the ocean floor or other underwater surface from which the tubular member extends. The apparatus includes an assembly which is disposable about the tubular member at the underwater surface, and which includes means by which fluid may be jetted for scouring the underwater surface about the tubular member in order that the assembly may move downwardly under its own weight. The tubular member is severed by means of a shaped charge carried by the assembly and adapted to be detonated when lowered with the assembly to the desired level.

25 Claims, 6 Drawing Figures

METHOD AND APPARATUS FOR SEVERING A TUBULAR MEMBER

This invention relates generally to a method and apparatus for severing a tubular member, and, more particularly, to an improved method and apparatus for severing the tubular member at a desired level beneath an underwater surface from which the tubular member extends.

This invention has particular utility in the drilling, completion and/or production of oil and gas wells from offshore platforms. Thus, for safety reasons, federal laws require that when the platform is removed from location, its support legs as well as conductor pipes extending from the wellhead on the platform to below the ocean floor must be severed at least a certain depth below the floor.

In some cases, it has been the practice to sever these tubular members by internal cutters adapted to be lowered into and remotely operated from the water surface in a well known manner. However, these tubular members are often filled with grout to a level at least above the ocean floor so that it has been necessary to use divers to sever the pipe. This requires the divers first excavate about the tubular member to the necessary level beneath the ocean floor. However, when the ocean floor is several hundred feet or more beneath the water surface, divers may not have time to sever the tubular member, much less first excavate about it to reach the depth at which it is to be severed.

Furthermore, in order to keep the excavated soil from caving in on him, the diver must normally make a conically shaped excavation of large diameter, which of course increases the time involved. Still further, it's difficult for the diver to determine the depth to which he has excavated, and even more difficult for the appropriate authorities to verify that the tubular member has been severed at the desired level.

The primary object of this invention is to provide a method and apparatus for severing such a tubular member which requires substantially less diver time, and, more particularly, which permit the means by which the pipe is to be severed to be so positioned as to sever it at the desired level with little or no diver participation.

A further object is to provide such a method and apparatus which, in their preferred embodiments, enable the tubular member to be severed, upon positioning of the severing means, without diver participation, so that diver time is required only to the extent necessary to properly position the severing means.

Another object is to provide such a method and apparatus in which the means by which the tubular member is severed is disposable, such that there is no need for excavating a large diameter hole to avoid cave-in, and wherein cave-in is instead beneficial to the procedure by which the tubular member is severed.

A more particular object is to provide such a method and apparatus which enables the depth to which the tubular member is severed to be accurately measured, and, if need by, the measurement certified, in a relatively simple manner making use of procedures and equipment inherent in the overall method and apparatus.

These and other objects are accomplished, in accordance with the illustrated embodiments of this invention, by apparatus which comprises an assembly adapted to be disposed about the tubular member and including means for severing the tubular member, as well as means through which fluid may be jetted for scouring the underwater surface about the tubular member in order that the assembly including the severing means may move downwardly under its own weight. More particularly, the apparatus also includes remotely operable means for causing fluid to be jetted from the scouring means, until the severing means has been lowered to the desired level, and for causing the severing means to sever the tubular member when so lowered.

Thus, a diver is required, if at all, only for the purpose of disposing the assembly about the tubular member, and even for that purpose only if the tubular member has radial enlargements above the underwater surface which prevent the assembly from being lowered down along it and onto the subsurface level by means of a wire line or the like. Thus, for example, if the tubular member is a leg of an offshore platform, the assembly would be split along its circumference, so that a diver may move it laterally into disposal about the tubular member after it has been lowered on the wire line onto the underwater surface adjacent the tubular member.

In the preferred and illustrated embodiments of the invention, the means by which the tubular member is severed includes an explosive charge which substantially surrounds the tubular member, and the remotely operable means includes means for detonating the charge when the charge is positioned to sever the tubular member at the desired level. More particularly, as illustrated, the explosive charge may include a body carrying a shaped charge on its inner side which faces the tubular member, and the means for detonating the charge may include a line extending to the charge from means at the water surface, such as a reel aboard a vessel, by which the depth of the charge may be measured. Since at least the severing means is disposable, the user need not be concerned that the soil which is scoured as the assembly is lowered will, in due time, cave over the assembly. In fact, covering of the assembly by the soil is useful in tamping the charge and preventing dissipation of its force to its intended task.

More particularly, the preferred embodiment of the assembly also includes means through which air may be jetted into scoured soil thereabove, and the apparatus further comprises remotely operable means for causing air under pressure to be jetted therefrom as the assembly is lowered. This lightens or fluidizes the scoured soil so as to facilitate its removal upwardly about the tubular member.

In the illustrated and preferred embodiments of the invention, the means for scouring the underwater surface comprises substantially annular chamber means having holes through which fluid may be jetted, and the fluid is supplied to the chamber means by a hose leading from a remote source of fluid under pressure, which may be aboard the vessel at the water surface, until the explosive charge has been lowered to the position for severing the tubular member at the desired level. More particularly, it also includes additional chamber means having holes through which the air under pressure may be jetted for fluidizing scoured soil above the assembly when supplied thereto from a remote source, such as the vessel from which scouring fluid is supplied. As also illustrated, the hose, like the detonating line, may be paid out from a reel on the vessel to provide a means by which the depth of the charge may be measured.

In the drawings, wherein like reference characters are used throughout to designate like parts:

FIG. 1 is an elevational view of one embodiment of apparatus constructed in accordance with the present invention, with the assembly shown disposed about a tubular member at the underwater surface, and broken away in part, and a hose and detonating line leading from the chamber means and the explosive charge of the assembly, respectively, to a reel on the vessel at the water level, and with the tubular member as well as the line and hose being interrupted intermediate their upper and lower ends to illustrate the considerable depth of the underwater surface below water level;

Figure 3:
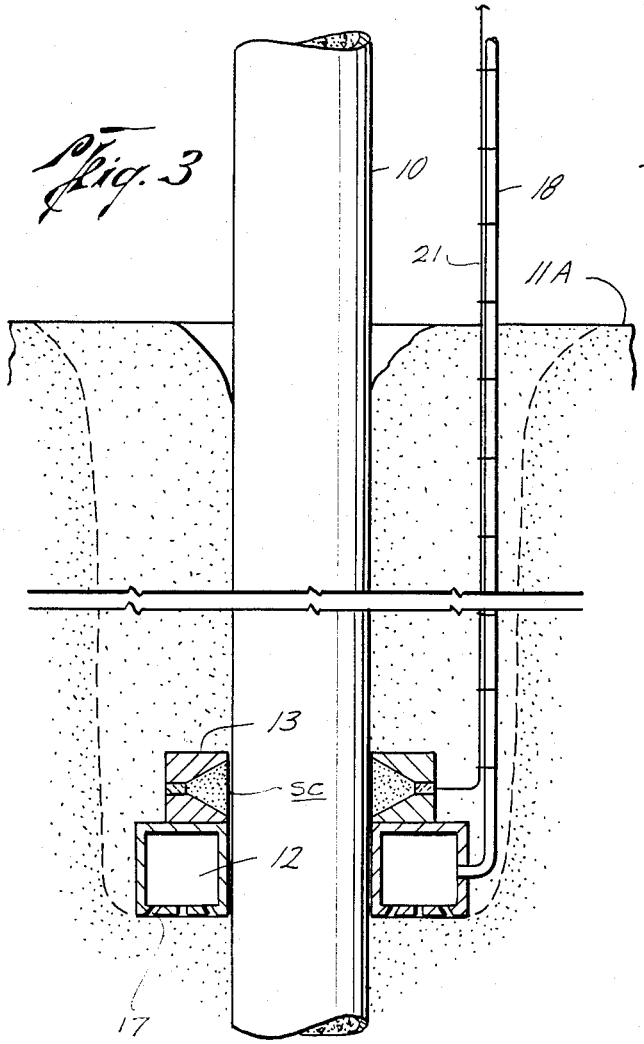
FIG. 3 is another elevational view, similar to FIG. 2, but following further lowering of the assembly to position the explosive charge for severing the pipe at the desired level, and cave-in or collapse of the scoured soil above the assembly the tubular member.
Figure 4:
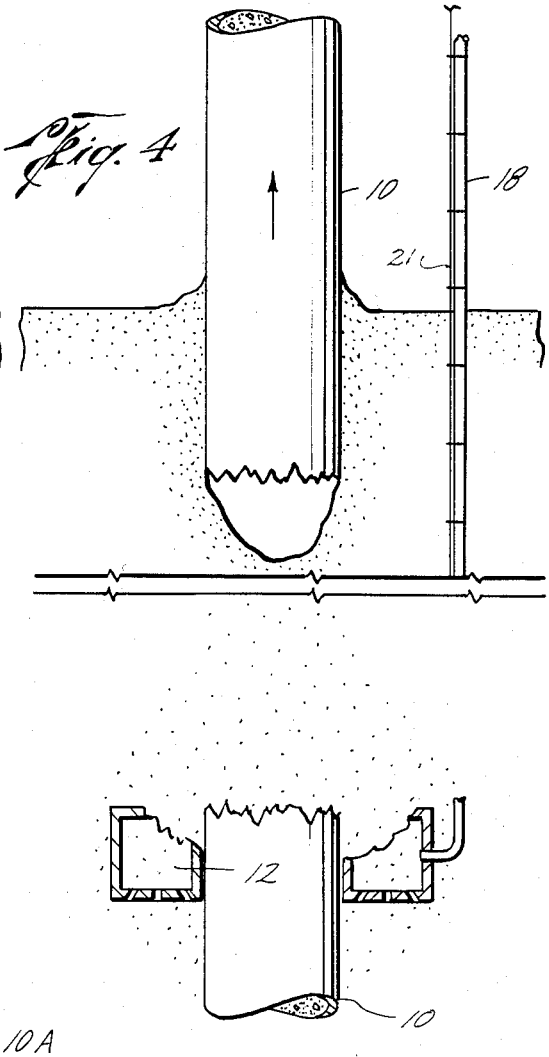
Figure 5:
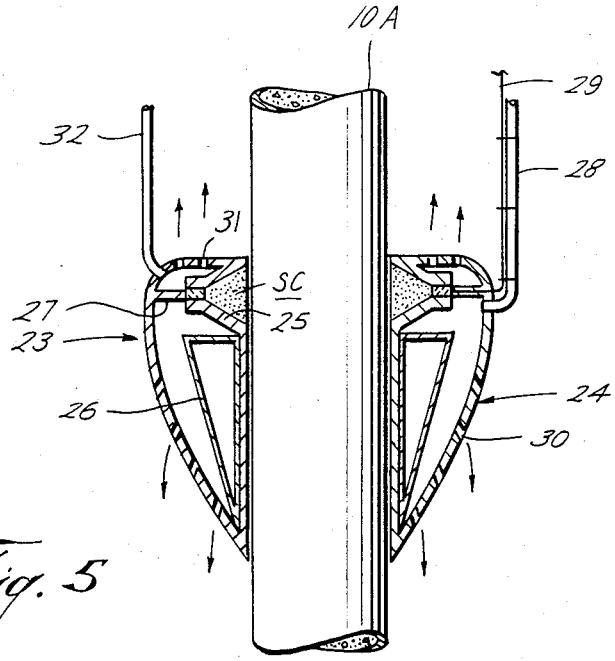

FIG. 4 is still another elevational view, similar to FIG. 3, but upon detonation of the explosive charge to sever the tubular member, and showing the upper portion of the tubular member as it is lifted from the lower portion thereof; and FIG. 5 is a partial elevational view of an alternative embodiment of the apparatus of the present invention, with the assembly thereof in section and lowered along the tubular member to the ocean floor.

Figure 1:
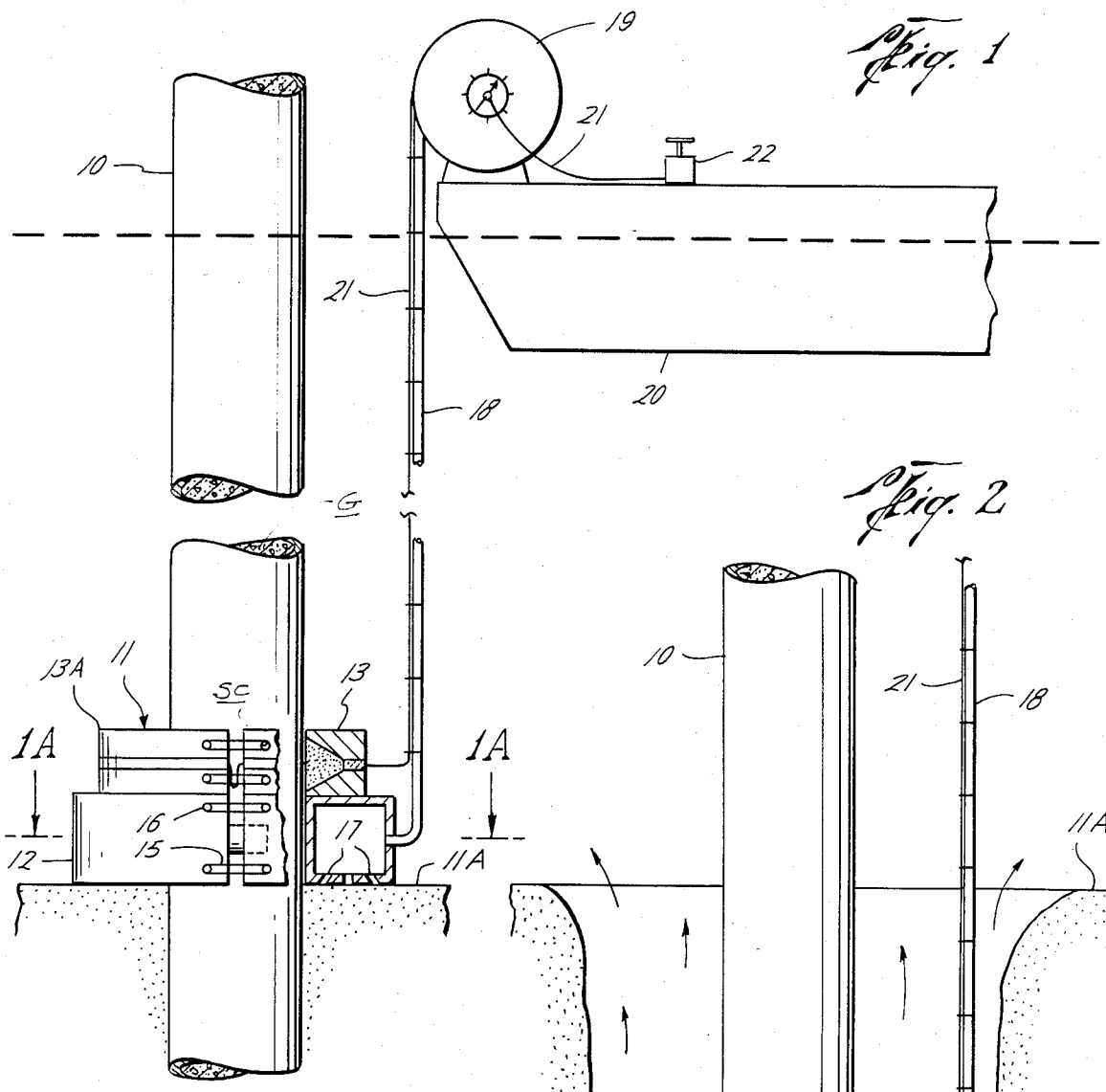
FIG. 1A is a cross-sectional view of the assembly, as shown along broken lines 1A—1A of FIG. 1.
Figure 1A:
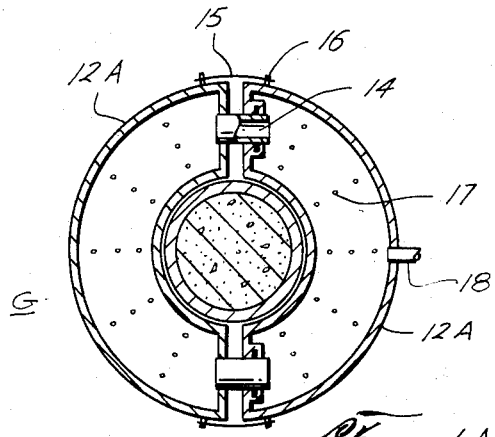

As shown in FIGS. 1 and 1A, an assembly 11 constructed in accordance with the first described embodiment of this invention is disposed about a tubular member 10 which extends upwardly from the ocean floor 11 or other underwater surface. The member 10, which may be the leg of an offshore platform or other member having radial enlargements above the underwater surface, is filled with grout G up to at least the ocean floor. The assembly is split about its circumference to permit a diver to move it laterally thereabout after it has been lowered onto the underwater surface by wire line or the like.

As shown, and above described, the assembly includes hollow housing means 12 which provides chamber means from which fluid may be jetted to scour the ocean floor about member 11, and body means 13 carrying the severing means mounted above and supported by the housing means 12 for lowering therewith. As also illustrated, housing means 12 includes substantially semi-circular housing sections 12A, and the body means 13 includes substantially semi-circular body sections 13A. The sections of the housing means and body means are releasably connectible about the tubular member so as to dispose their inner arcuate sides close to the outer diameter of the tubular member. More particularly, the sections 12A of the housing means are fluidly connected with one another, when disposed about the tubular member, by short pipe sections 14 extending through the oppositely facing end walls of the housing sections so that scouring fluid may be supplied to both sections through a single hose leading from a remote source, as will be described. Each of the body sections 13A carries an arcuate shaped charge SC with the charges connected to one another and to a remote source by a line leading to a detonator, as will also be described.

As illustrated, the body sections 13A and housing sections 12A are held about the tubular member by elastic bands 15 which are stretched to dispose their opposite ends disposed over pins 16 on the outer sides of the housing sections and body sections adjacent the circumferential splits thereof. Although not shown, the body sections 13A for the shaped charge may include means for providing the desired amount of standoff between the inner face of the charge and the outer diameter of the tubular member.

Holes 17 are formed in the lower ends of the housing sections 12A so as to permit water or other fluid to be jetted from the housing means against the underwater surface in order to scour it and thereby enable the entire assembly 11 to be lowered under its own weight about the tubular member, as shown in FIG. 1. The fluid is supplied under pressure to the housing sections by means of a hose 18 which may be payed out from a reel 19 mounted on a vessel 20 located at the water surface near the tubular member. A line 21 connects the shaped chargesections with one another and extends upwardly to the reel 19 from which it may be paid out with hose 18 and from the reel to a detonator 22 on the vessel. As shown, the reel is located at an end of the vessel which is preferably disposed substantially vertically above the assembly, so that the length of both the hose 18 and the detonating line 21 are a measure of the depth at which the assembly is located beneath the water surface.

Figure 2:
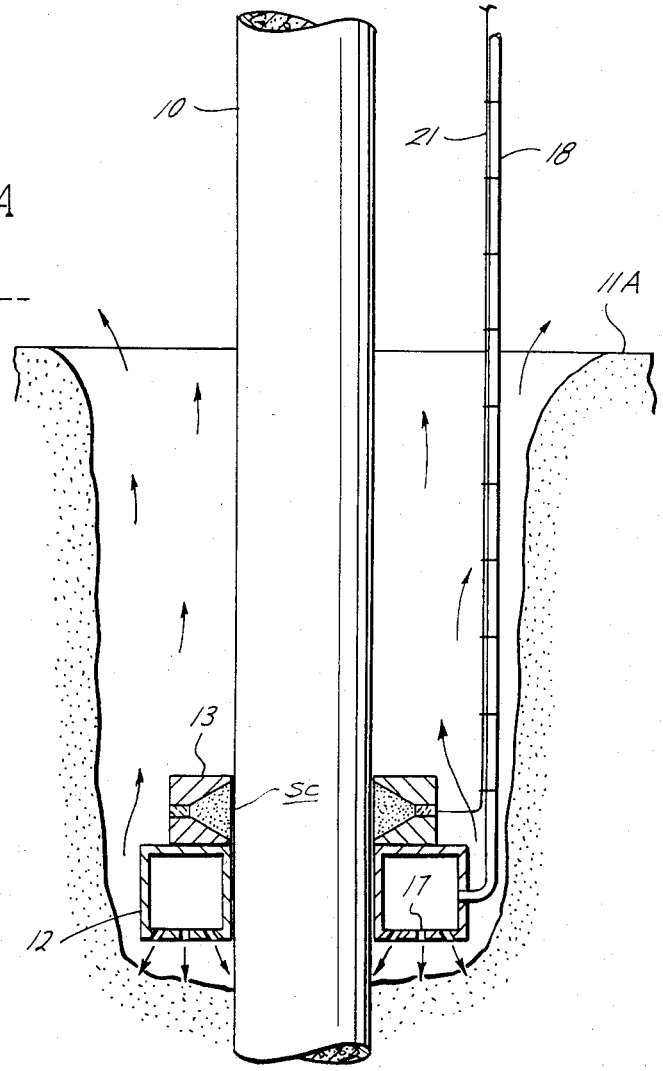
FIG. 2 is an elevational view of the tubular member and severing apparatus, similar to FIG. 1, but showing the entire assembly in vertical section, and further showing the assembly as it is lowered under its own weight about the tubular member as fluid is jetted from the assembly to scour the underwater surface beneath it.

The hose is connected with a suitable pump (not shown) located on the vessel so that when the scouring fluid is supplied through it to the hollow housing sections, it is jetted forcefully through the ports 17. As the scoured soil moves upwardly above the assembly and the tubular member, as indicated by the arrows in FIG. 2, some of it will accumulate on surrounding areas of the ocean floor. If the assembly, including the housing means and body means, is not sufficiently heavy to cause the assembly to be lowered under its own weight, more weight may be added to the assembly.

Instead of water, the fluid for scouring the underwater surface may be a combination of air and water, or a specially treated liquid of some type. Also, although the tubular member is preferably severed by an explosive charge, as above described, this invention contemplates that it may be otherwise severed, as by chemical cutting or other means adapted to be operated from a remote location and thus not requiring the services of a diver.

As above described, when the assembly has been lowered to a depth for positioning the explosive charge opposite the level at which the tubular member is to be severed, the supply of fluid under pressure to the housing means 12 is stopped, so as to discontinue the scouring action. As shown in FIG. 3, soil scoured from the underwater surface will settle back about the tubular member and over the assembly 11, and the portion thereof which has accumulated on the surrounding ocean floor will in time follow. This will occur, of course, as a natural consequence and without any need for backfilling or the like by divers or other means. As also previously mentioned, this has a desirable effect in accordance with the preferred embodiment of this invention, since the soil above the assembly will serve to tamp the explosive charge in place and prevent its force from being dissipated.

In any event, following lowering of the explosive charge with the assembly to the desired level, as shown in FIG. 3, the charge is detonated by actuation of the means 22 aboard vessel 20 so as to sever the pipe. As indicated in FIG. 4, this will destroy not only the body means 13 carrying the shaped charge, but also at least portions of the housing means 12 from which scouring fluid is jetted. However, as also previously mentioned, this invention contemplates that the assembly is in any event disposable in the sense that no effort is made to recover any or all of it. Instead, as indicated in FIG. 4, the upper portion of the severed member 10 is merely lifted so as to leave the lower portion in place. The hose 18 and detonating line 21 being cut from the reel to permit them to merely fall onto the ocean floor. As shown in FIG. 1, a dial on the reel 19 provides a means by which the amount of hose and line paid out may be measured. Obviously, this measurement may also be automatically recorded in some manner so as to provide means by which appropriate authorities may verify the fact that the charge has been lowered to the desired depth.

In the alternative embodiment of the invention shown in FIG. 3, the assembly 23 is circumferentially continuous for disposal about a tubular member 10A which is free of radial enlargements from the ocean floor to the water level. That is, this embodiment of the invention contemplates that the assembly may be lowered along the tubular member 10A from the water surface to the ocean floor. As in the case of the tubular member 10, tubular member 10A is filled with grout at least to the level of the ocean floor.

The assembly 23 includes an annular housing 24 which has downwardly and inwardly extending outer walls, and which carries an annular body 25 for a shaped charge SC on its upper end. The interior of the chamber within the housing and about the body 25 for the shaped charge is divided by a lateral wall into upper and lower chambers. An inner body 26 within the lower chamber of the housing provides a chamber into which air or other light fluid may be introduced to lend buoyancy to the assembly, and thus lighten its weight should this be necessary, as for example for handling purposes in lowering it onto the ocean floor.

Holes 30 formed in the outer wall of the housing 24 extend in a downward direction so that fluid under pressure within the lower chamber of the housing may be jetted downwardly in order to scour the ocean floor beneath the assembly. This fluid may be supplied to the lower chamber through a hose 28 leading from a remote source of the fluid under pressure, as described in connection with the embodiment of FIGS. 1 to 4. Similarly, a line 29 may extend from a remotely located detonator, which may also be aboard a vessel, as shown in FIGS. 1 to 4, and lead to the shaped charge SC carried by the body 25.

Holes 31 are formed in the upper wall of the housing above the upper chamber to enable fluid under pressure to be jetted therefrom as it is lowered beneath the ocean floor. A hose 32 connects with the upper chamber so as to permit such fluid, which may be air, to be supplied from a remote source of same under pressure, which of course may also be on the vessel. As previously described, this air will fluidize and thus lighten the soil above the assembly so as to facilitate a continuing flow of the soil upwardly from beneath the assembly as the ocean floor continues to be scoured. The supply of compressed air to the upper chamber will, of course, be discontinued at or about the same time that the flow of scouring fluid is discontinued.

In all other respects, the apparatus of this alternative embodiment of the invention is used in the performance of the method as described in connection with the embodiment of FIGS. 1 to 4.

From the foregoing it will be seen that this invention is one well adapted to attain all of the ends and objects hereinabove set forth, together with other advantages which are obvious and which are inherent to the apparatus and method.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Apparatus for use in severing a tubular member at a desired level beneath an underwater surface from which the tubular member extends, said apparatus comprising an assembly adapted to be disposed about the tubular member at the underwater surface and including means for severing the tubular member, and means through which fluid may be jetted for scouring the underwater surface about the tubular member in order that the assembly may move downwardly about the tubular member, under its own weight, and remotely operable means for jetting fluid from the scouring means, until the severing means has been lowered with the assembly to the desired level, and for operating the severing means to sever the tubular member when so lowered.

2. Apparatus of the character defined in claim 1, wherein the assembly is split about its circumference to permit it to be moved laterally into disposal about the tubular member.

3. Apparatus of the character defined in claim 1, wherein said assembly also includes means through which air may be jetted for fluidizing scoured soil thereabove, and the remotely operable means also causes air under pressure to be jetted from the fluidizing means.

4. Apparatus for use in severing a tubular member at a desired level beneath an underwater surface from which the tubular member extends, said apparatus comprising an assembly adapted to be disposed about the tubular member at the underwater surface, and including means for severing the tubular member which includes an explosive charge which substantially surrounds the tubular member, and means through which fluid may be jetted for scouring the underwater surface about the tubular member in order that the assembly may move downwardly about the tubular member, under its own weight, and remotely operable means for jetting fluid from the scouring means, until the explosive charge has been lowered with the assembly to the desired level, and for detonating the charge when so lowered.

5. Apparatus of the character defined in claim 4, wherein the explosive charge includes body means carrying a shaped charge on the inner side thereof facing the tubular member.

6. Apparatus of the character defined in claim 4, wherein the detonating means includes a line extending to the charge from means at the water surface by which the depth of the charge may be measured.

7. Apparatus of the character defined in claim 4, wherein the assembly is split about its circumference to permit it to be moved laterally into disposal about the tubular member.

8. Apparatus of the character defined in claim 4, wherein said assembly also includes means through which air may be jetted for fluidizing scoured soil thereabove, and the remotely operable means also causes air to be jetted from the fluidizing means.

9. Apparatus for use in severing a tubular member at a desired level beneath an underwater surface from which the tubular member extends, said apparatus comprising an assembly adapted to be disposed about the tubular member at the underwater surface, and including means for severing the tubular member, and substantially annular chamber means having holes through which fluid may be jetted for scouring the underwater surface about the tubular member in order that the assembly may move downwardly about the tubular member under its own weight, means including a hose leading from a remote source to the chamber means for supplying fluid under pressure to the chamber means until the severing means has been lowered to the desired level, and remotely operable means for operating the severing means to sever the tubular member when so positioned.

10. Apparatus of the character defined in claim 9, wherein the assembly also includes buoyancy chamber means.

11. Apparatus of the character defined in claim 9, wherein said assembly also includes additional annular chamber means having holes through which air under pressure may be jetted for fluidizing scoured soil thereabove, and means including an additional hose leading from a remote source to the additional chamber means for supplying air under pressure thereto as the assembly is so lowered.

12. Apparatus of the character defined in claim 9, wherein the hose extends from a means at the water surface by which the depth of the severing means may be measured.

13. Apparatus of the character defined in claim 9, wherein the severing means includes an explosive charge which substantially surrounds the tubular member, and the remotely operable means includes means for detonating the charge.

14. Apparatus of the character defined in claim 13, wherein the assembly includes body means and the explosive charge includes body means carrying a shaped charge carried on the inner side thereof facing the tubular member.

15. Apparatus of the character defined in claim 13, wherein the detonating means includes a line extending to the charge from means at the water surface by which the depth of the charge may be measured.

16. Apparatus of the character defined in claim 9, wherein the assembly is split about its circumference to permit it to be moved laterally into disposal about the tubular member.

17. A method of severing a tubular member at a desired level beneath an underwater surface from which the tubular member extends, said method comprising the steps of disposing about the tubular member at the subsurface level an assembly which includes means for severing the tubular member, and means through which fluid may be jetted for scouring the underwater surface about the tubular member in order that the assembly may move downwardly about the tubular member under its own weight, supplying fluid under pressure to the scouring means from a remote source in order to scour the underwater surface until the severing means has been lowered with the assembly to the desired level, and activating the severing means from a remote source, when it has been so lowered, so as to sever the tubular member at said level.

18. A method of the character defined in claim 17, wherein the assembly also includes means through which air may be jetted for fluidizing the scoured soil above the assembly, and including the further step of supplying air under pressure to the fluidizing means from a remote source in order to fluidize the scoured soil above the assembly as it is lowered.

19. A method of the character defined in claim 17, wherein the assembly is split about its circumference, and including the further step of moving the assembly laterally into disposal about the tubular member.

20. A method of severing a tubular member at a desired level beneath an underwater surface from which the tubular member extends, said method comprising the steps of disposing about the tubular member at the subsurface level an assembly which includes an explosive charge which substantially surrounds the tubular member, and means through which fluid may be jetted for scouring the underwater surface about the tubular member in order that the assembly may move downwardly about the tubular member under its own weight, supplying fluid under pressure to the scouring means from a remote source in order to scour the underwater surface until the explosive charge has reached the desired level, and detonating the explosive charge from a remote source, when it has been so lowered, so as to sever the tubular member at said level.

21. A method of the character defined in claim 20, wherein the explosive charge includes body means and the explosive charge is a shaped charge carried on the inner side thereof facing the tubular member.

22. A method of the character defined in claim 20, wherein the detonating means includes a line extending to the charge from means at the water surface by which the depth of the charge may be measured.

23. A method of severing a tubular member at a desired level beneath an underwater surface from which the tubular member extends, said method comprising the steps of disposing about the tubular member at the subsurface level an assembly which includes means for severing the tubular member, and substantially annular chamber means having holes through which fluid may be jetted for scouring the underwater surface about the tubular member in order that the assembly may move downwardly about the tubular member under its own weight, supplying fluid under pressure to the chamber means through a hose extending from a remote source in order to scour the underwater surface until the severing means has reached the desired level, and activating the severing means from a remote source, when it has been so lowered, so as to sever the tubular member at said level.

24. A method of the character defined in claim 23, wherein the assembly also includes additional chamber means having holes through which air may be jetted for fluidizing the scoured soil above the assembly, and including the further step of supplying air under pressure to the additional chamber means through an additional hose extending thereto from a remote source in order to fluidize the scoured soil above the assembly as the assembly is so lowered.

25. A method of the character defined in claim 24, wherein the hose extends from a means at the water surface by which the depth of the severing means may be measured.

* * * * *